US008415547B1

(12) United States Patent
Albritton, Jr.

(10) Patent No.: US 8,415,547 B1
(45) Date of Patent: Apr. 9, 2013

(54) ELBOW DRUM

(76) Inventor: Clarence L. Albritton, Jr., Mitchellville, MD (US)

( * ) Notice: Subject to any disclaimer, the term of this patent is extended or adjusted under 35 U.S.C. 154(b) by 0 days.

(21) Appl. No.: 12/007,993

(22) Filed: Jan. 18, 2008

Related U.S. Application Data

(60) Provisional application No. 60/936,018, filed on Jun. 18, 2007.

(51) Int. Cl.
*G10D 13/02* (2006.01)

(52) U.S. Cl. ..... 84/411 R

(58) Field of Classification Search ..... 84/411 R, 84/421
See application file for complete search history.

(56) References Cited

U.S. PATENT DOCUMENTS

| | | | | |
|---|---|---|---|---|
| 3,603,194 | A * | 9/1971 | North | 84/411 R |
| D242,876 | S * | 12/1976 | Clements et al. | D17/22 |
| 4,102,236 | A * | 7/1978 | North | 84/411 R |
| 6,162,977 | A * | 12/2000 | Cohen | 84/411 R |
| 7,462,770 | B2 * | 12/2008 | Dunnett | 84/411 R |

* cited by examiner

*Primary Examiner* — Kimberly Lockett
(74) *Attorney, Agent, or Firm* — Conwell Law LLC; H. Robert Field, Esq

(57) ABSTRACT

The present invention is drawn to a percussion instrument or drum, having an "elbow" shaped tubular body which curves through an approximate 90 degree angle with the head of the drum.

4 Claims, 4 Drawing Sheets

ELBOW DRUM

CROSS REFERENCE TO RELATED APPLICATIONS

This application claims priority to U.S. Provisional Application No. 60/936,018, filed Jun. 18, 2007. The contents of Provisional Application No. 60/936,018 are incorporated by reference, including all text and drawings.

BACKGROUND

1. Field of the Invention

This invention relates to a percussion musical instrument.

2. Background of the Invention

Drums are well known in the art of music and are well known in various cultures and civilizations. Drums are used for ceremonial purposes, communication and also for entertainment and for their musical qualities. Drums are usually struck and can be made from wood, hides, metal, plastic, or other materials. Drums are usually struck, either with an implement, stick, mallet or other striking device, or can be struck using the user's hands. Examples of drums include bongos, snare drums, Asian gong-type drums, ceremonial or religious bronze bells (such as those used in Buddhist temples or church steeples), drums used by tribal peoples worldwide, and used as toys.

SUMMARY OF THE INVENTION

The present invention is drawn to a percussion instrument having a head for striking the instrument, attached to a tubular body curving through an angle, which in the preferred embodiment is at about a 90 degree angle to the head of the instrument. The instrument will produce a sound different than with other percussion instruments and provides a distinct visual impact when used alone or in combination with other instruments.

DETAILED DESCRIPTION OF THE INVENTION

Figure 1:
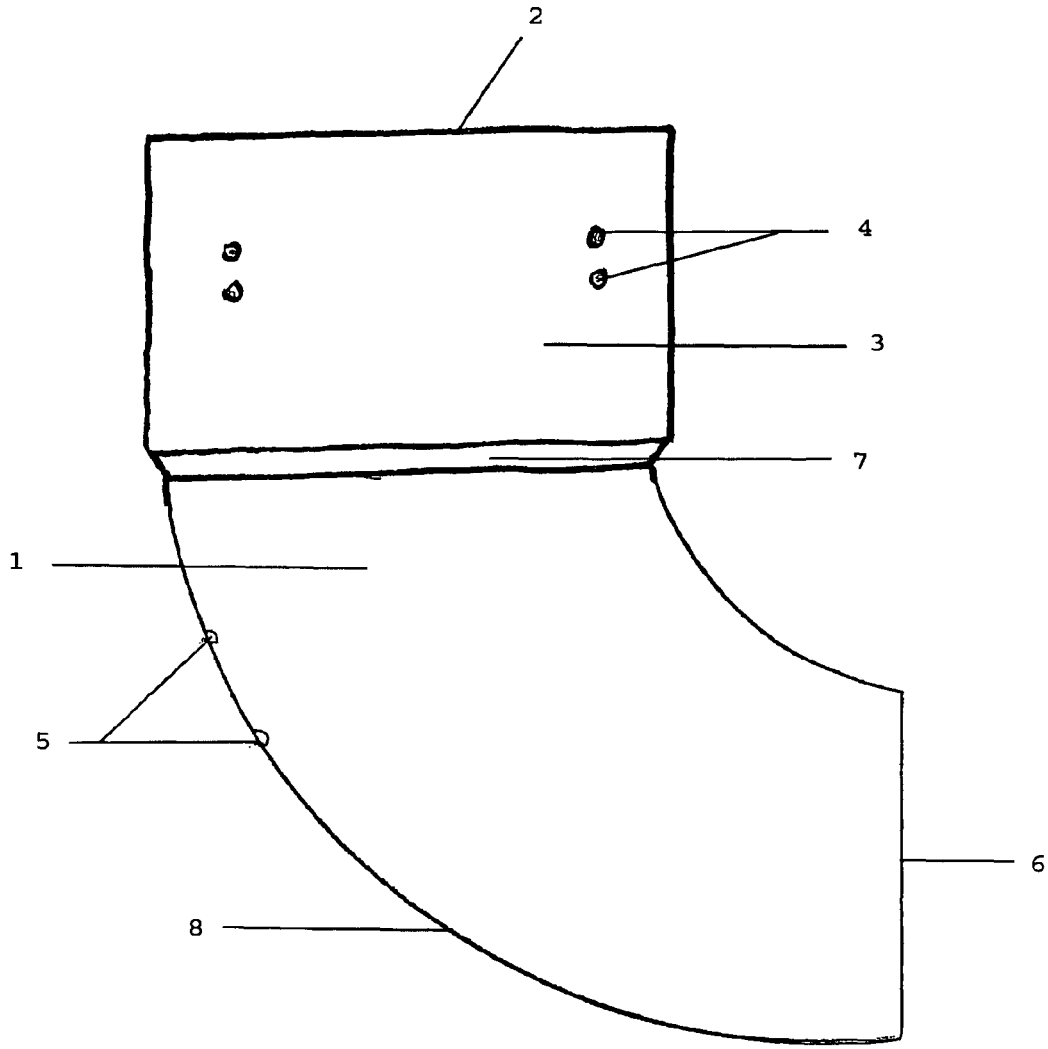
FIG. 1 depicts a side view of a drum having a head portion and a curved body at approximately 90 degrees with the striking surface of the drum.
Figure 2:
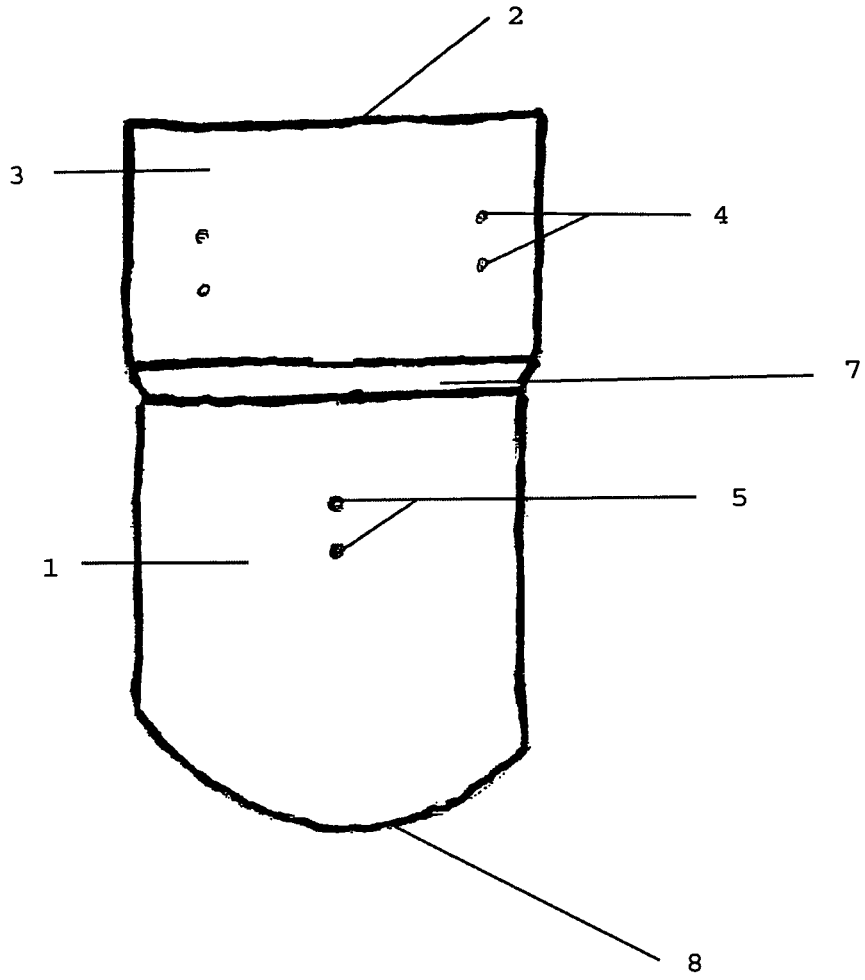
FIG. 2 shows a back view of a drum having a head portion and a curved body at approximately 90 degrees with the striking surface of the drum.

The Elbow Drum is a musical instrument of the percussion family. The present invention is drawn to a percussion instrument. Such an instrument is commonly known as a "drum" or "bongo." Unlike drums or bongos used currently, the present invention includes an "elbow" shape in the body 1 of the drum which curves through at an approximate 90 degree angle with the striking head or rim 2 of the instrument (FIGS. 1 and 2). A drum shell, also known as a drum head 3 supports the striking head 2. The striking head 2 is attached to a rim which is secured to the drum body by lugs. The drum body 1 has a 90 degree curve 8 between the drum head 3 and the acoustical end 6; connected by way of the drum head connector or neck

7. The 90 degree angle in the body results in the acoustical end resting at approximately a right angle to the striking head 2 of the instrument. Holes provided in the drum head 3 are spaced around the drum head, for the purpose of attaching the striking head 2 and attached rim to the drum shell 3 via lugs. Holes 5 in the body of the drum allow for attachment of the drum to drum stands via a bracket, to each other, or to existing drum sets as known in the art.

The drum of the invention can be made of wood or metal or PVC; and the drum head or striking head 2 and acoustical end 6 can be covered with a membrane tightly drawn on a drum shell 3. The acoustical end of the drum may be open or covered, as determined by an artisan in the field and determined on the basis of acoustical or aesthetic properties. The membrane covering the drum shell may be made of MYLAR, skins or KEVLAR, as known in the art. The percussion instrument makes sounds by tapping or striking the striking head 2 of the drum. Bongo drums are known in the art to be played by the users hands. Another embodiment of the invention is a drum which would be stuck using a stick or rod, or other striking implement, such as a drumstick. "Elbow" as used herein includes any angle of curve in the drum body. In particular, "elbow" is commonly known in the art to comprise angles from about 45 degrees to about 90 degrees.

WORKING EXAMPLES

Example 1

Figure 3:
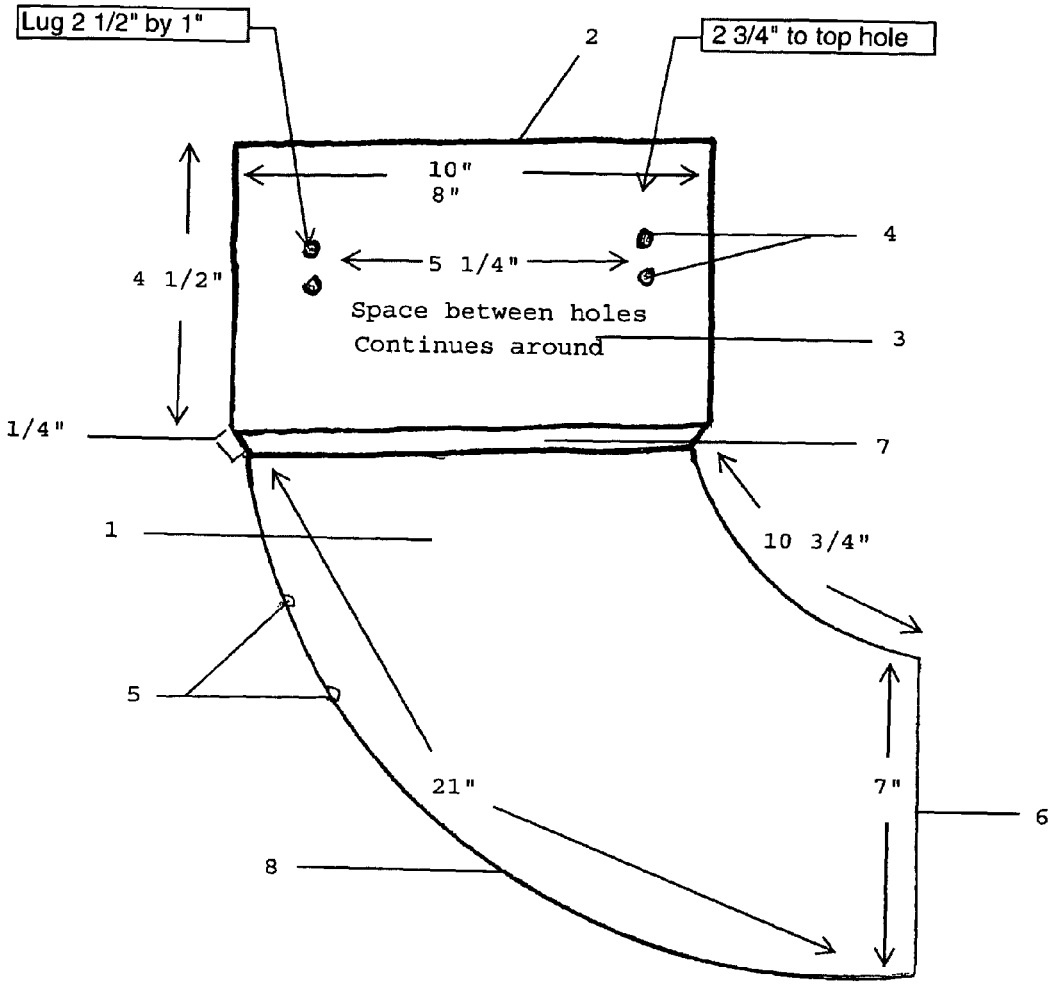
FIG. 3 depicts a side view of a drum including measurements for one embodiment of the invention.
Figure 4:
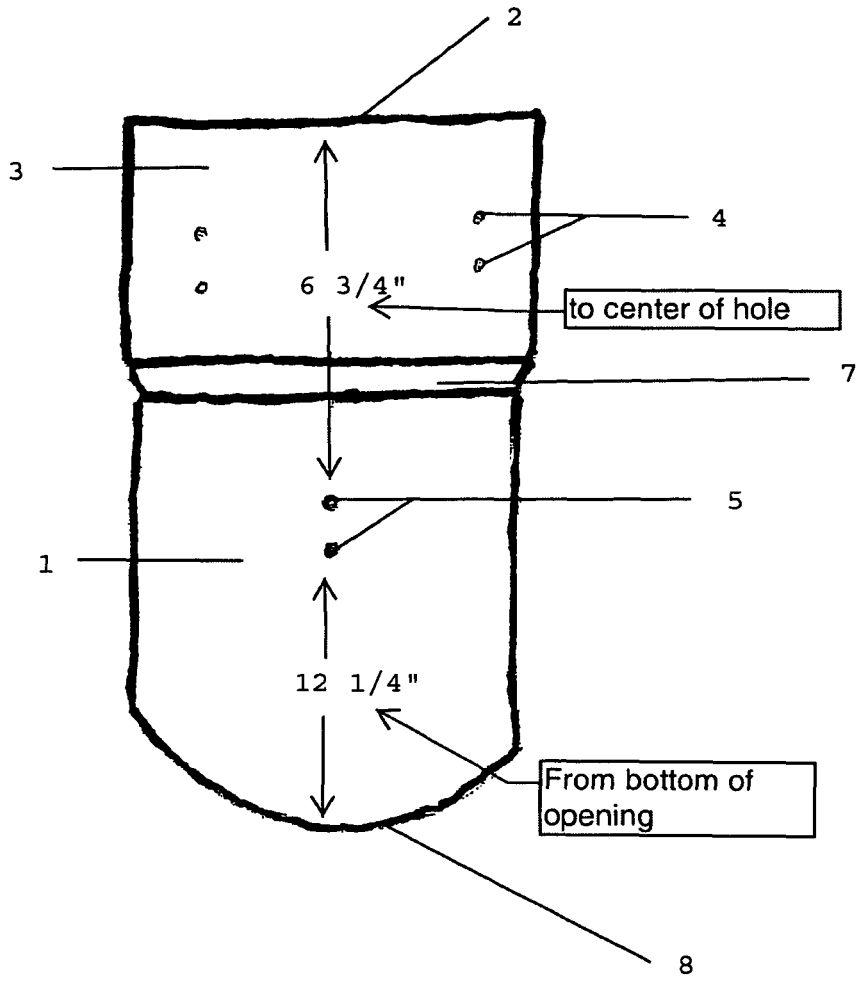
FIG. 4 shows a back view of a drum of the invention, including measurements for one embodiment of the invention.

FIGS. 3 and 4 depict the measurements of one embodiment of the invention. FIG. 3 shows the placement of the holes to be 5¼ inches; however, other measurements can be envisioned, such as 6¼ inches or other distances as determined by an artisan. The diameter of the drum head can be 8 or 10 inches as depicted in FIG. 3, or in the range of 8 inches to 14 inches, 6 inches to 14 inches, and including the embodiments of 7½ inches or 7¾ inches. All other measurements as depicted in FIG. 3 would be easily adjustable by an artisan to accommodate the differing drum head sizes and acoustical qualities. Lugs to attach the drum head may be either custom made or commercially-available as known to artisans in the field. The holes may accommodate lugs which may be with or without inserts or screws as commonly used in the art.

Attachments to the holes 5 in the body of the drum may be adjustably affixed utilizing either custom-made or commercially-available attachment brackets. One such attachment bracket could be a Gibraltar SC-TL2 bracket.

Having now fully described this invention, it will be understood to those of ordinary skill in the art that the same can be performed within a wide and equivalent range of conditions, formulations, and other parameters without affecting the scope of the invention or any embodiment thereof. All patents and publications cited herein are incorporated by reference in their entirety.

I claim:

1. A percussion instrument comprising a tubular drum head supporting a striking head end with means for securing said striking head end to said tubular drum head; and further comprising a curved tubular drum body with an acoustical end opposite to said striking head end; and wherein said striking head end is larger than said acoustical end, further comprising a tubular drum head supporting a striking head end with means for securing said striking head end to said tubular drum head; and further comprising a curved tubular drum body with an acoustical end opposite to said striking head end; and wherein said striking head end is of a larger diameter than said acoustical end; and wherein the decrease in size between said striking head end and said acoustical end is in a regular, progressive manner.

2. The percussion instrument of claim 1, wherein said curved tubular body is closed at said acoustical end.

3. The percussion instrument of claim 1, wherein a cross-section of said striking end and said acoustical end are circular.

4. The percussion instrument of claim 1, wherein said curved tubular body curves through an angle of approximately 90 degrees from the axis of said tubular drum head.

* * * * *